US006978950B2

(12) United States Patent
Bierstaker et al.

(10) Patent No.: US 6,978,950 B2
(45) Date of Patent: Dec. 27, 2005

(54) HIGH FLOW, TUBULAR CLOSURE MEMBER FOR A FUEL INJECTOR

(75) Inventors: John Edward Bierstaker, Yorktown, VA (US); James Paul Fochtman, Williamsburg, VA (US)

(73) Assignee: Siemens VDO Automotive Corporation, Auburn Hills, MI (US)

( * ) Notice: Subject to any disclaimer, the term of this patent is extended or adjusted under 35 U.S.C. 154(b) by 15 days.

(21) Appl. No.: 10/369,687

(22) Filed: Feb. 21, 2003

(65) Prior Publication Data

US 2004/0195384 A1 Oct. 7, 2004

(51) Int. Cl.[7] ..... B05B 1/30; F02M 59/00; F02M 41/00

(52) U.S. Cl. ..... 239/585.1; 239/585.3; 239/585.4; 239/585.5; 239/533.2; 239/88

(58) Field of Search ..... 239/585.1–585.5, 239/533.2, 533.3, 533.9, 533.11, 88–93; 251/129.15, 129.21, 127

(56) References Cited

U.S. PATENT DOCUMENTS 5,275,341 A * 1/1994 Romann et al. ..... 239/585.4
5,544,816 A * 8/1996 Nally et al. ..... 239/585.5
5,692,723 A * 12/1997 Baxter et al. ..... 251/129.21
5,996,911 A * 12/1999 Gesk et al. ..... 239/585.1
6,173,915 B1 * 1/2001 Cohen et al. ..... 239/585.1

* cited by examiner

*Primary Examiner*—Davis Hwu

(57) ABSTRACT

A fuel injector includes a housing, a passageway, a coil assembly, a seat, and a closure member. The housing extends along a longitudinal axis between an inlet and an outlet, and fuel flows through the passageway from the inlet to the outlet. The coil assembly is disposed proximate the inlet of the housing, and the seat is disposed proximate the outlet of the housing. The closure member is disposed in the housing and is movable along the longitudinal axis between a first position, which prohibits fuel flow, and a second position, which permits fuel flow. The closure member includes a magnetic member, a needle, and a tubular member. The magnetic member is adapted to cooperate with the coil assembly to move the closure member from the first position to the second position. The needle member occludes the seat in the first position of the closure member. The tubular member couples the magnetic member to the needle member, and defines a portion of the passageway. The tubular member extends between a first end, which defines a first opening, and second end, which defines a second opening. A portion of the first opening is aligned with the second opening such that fuel flow between the first and second openings is along a flow path that is parallel to the longitudinal axis.

18 Claims, 5 Drawing Sheets

HIGH FLOW, TUBULAR CLOSURE MEMBER FOR A FUEL INJECTOR

FIELD OF INVENTION

The invention relates to a closure member for a fuel injector, and more particularly to a closure member that provides straight line fuel flow paths.

BACKGROUND OF THE INVENTION

It is known to use a two-piece closure member that includes an armature connected to a needle, and to allow fuel flow through the known closure member. In particular, these known closure members are believed to have angled holes drilled through the armature such that fuel flow through the known closure member must make two turns or bends, i.e., at the entrance and exit of the angled holes. It is believed that the circuitous fuel flow path caused by these turns or bends, combined with the heavy armature of the known closure members, slows the movement, and hence response time, of these known closure members.

In order to increase closure member speed and improve fuel injector performance, it is believed that there is a need to eliminate the turns or bends in the fuel flow path and to reduce the weight of known closure members

SUMMARY OF THE INVENTION

The present invention provides a fuel injector that includes a housing, a passageway, a coil assembly, a seat, and a closure member. The housing extends along a longitudinal axis between an inlet and an outlet, and fuel flows through the passageway from the inlet to the outlet. The coil assembly is disposed proximate the inlet of the housing, and the seat is disposed proximate the outlet of the housing. The closure member is disposed in the housing and is movable along the longitudinal axis between a first position, which prohibits fuel flow, and a second position, which permits fuel flow. The closure member includes a magnetic member, a needle, and a tubular member. The magnetic member is adapted to cooperate with the coil assembly to move the closure member from the first position to the second position. The needle member occludes the seat in the first position of the closure member. The tubular member couples the magnetic member to the needle member, and defines a portion of the passageway. The tubular member extends between a first end, which defines a first opening, and second end, which defines a second opening. A portion of the first opening is aligned with the second opening such that fuel flow between the first and second openings is along a flow path that is parallel to the longitudinal axis.

The present invention further provides a closure assembly that moves along a longitudinal axis between a first position, which prohibits fuel flow through a fuel injector, and a second position, which permits fuel flow through the fuel injector. The closure member includes an acting member, an occluding member, and a tubular member. The acting member is influenced to cause movement from the first position to the second position. The occluding member prohibits fuel flow in the second position. And the tubular member couples the acting member to the occluding member. The tubular member extends between a first end, which defines a first opening, and second end, which defines a second opening. A portion of the first opening is aligned with the second opening such that fuel flow between the first and second openings is along a flow path that is parallel to the longitudinal axis.

The present invention further provides a method of manufacturing a closure member for a fuel injector. The method includes coupling a magnetic member to a first end of a tubular member, inserting a needle member in a second end of the tubular member, and crimping the second end of the tubular body. The inserting includes positioning an exterior surface of the needle member to confront an interior surface of the tubular member. And the crimping includes contiguously engaging a first portion of the interior surface of the tubular member with a first portion of the exterior surface of the needle member, and includes spacing a second portion of the interior surface of the tubular member with a second portion of the exterior surface of the needle member.

BRIEF DESCRIPTION OF THE DRAWINGS

The accompanying drawings, which are incorporated herein and constitute part of this specification, illustrate presently preferred embodiments of the invention, and, together with the general description given above and the detailed description given below, serve to explain features of the invention.

DETAILED DESCRIPTION OF THE PREFERRED EMBODIMENT(S)

Figure 1:
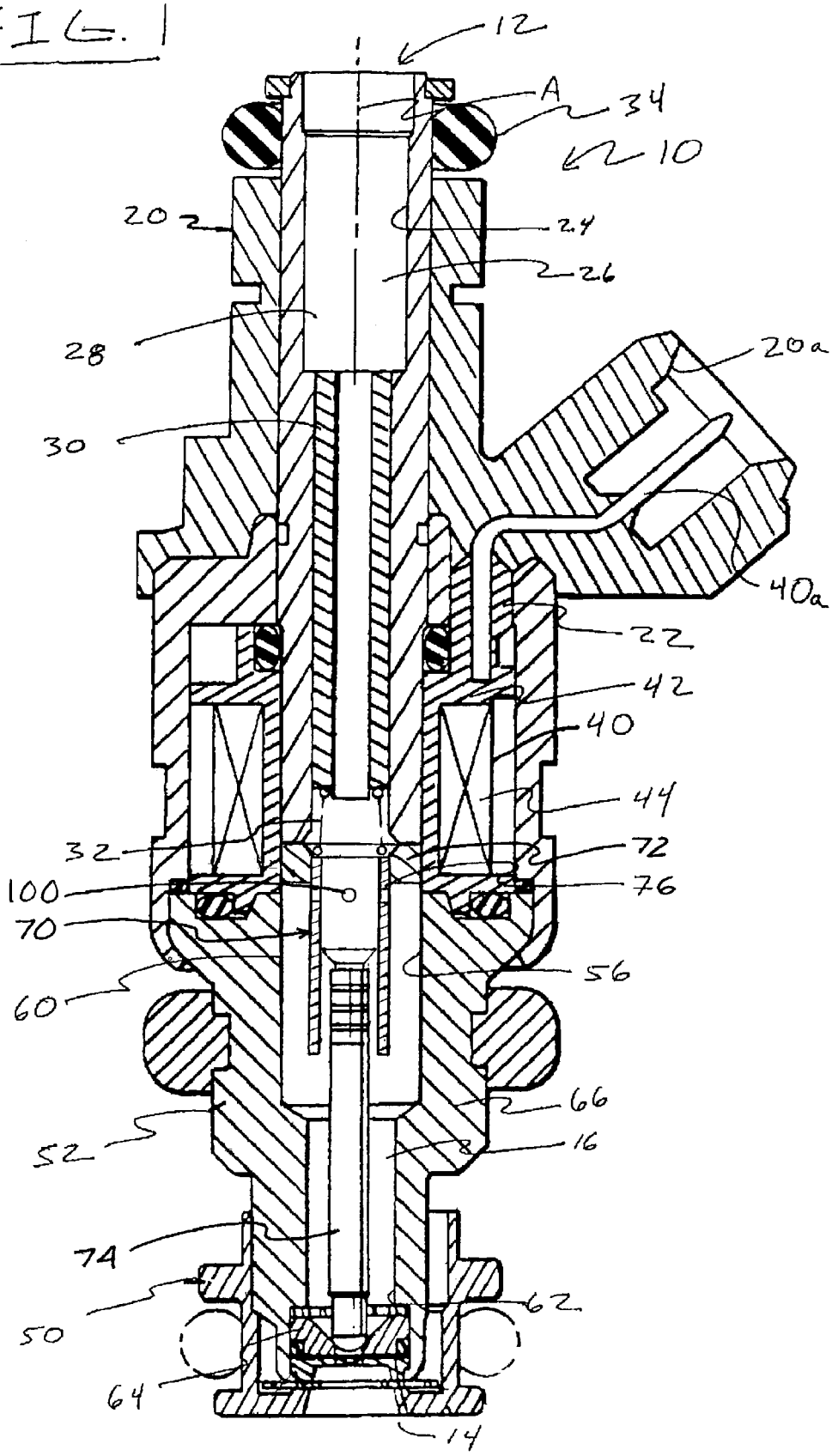
FIG. 1 is a cross-sectional view of a fuel injector assembly including a closure member according to a preferred embodiment.
Figure 2:
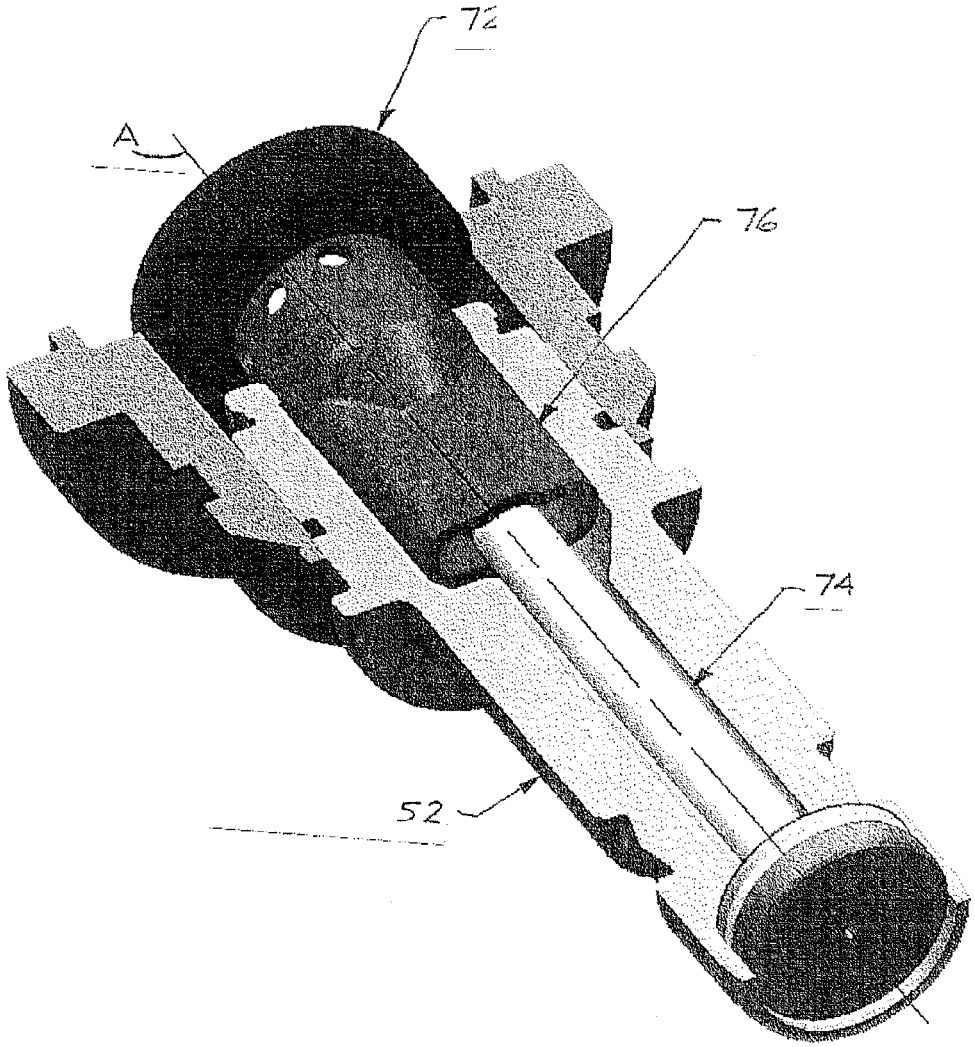
FIG. 2 is a partial cross-section view of a detail of the fuel injector shown in FIG. 1.
Figure 3:
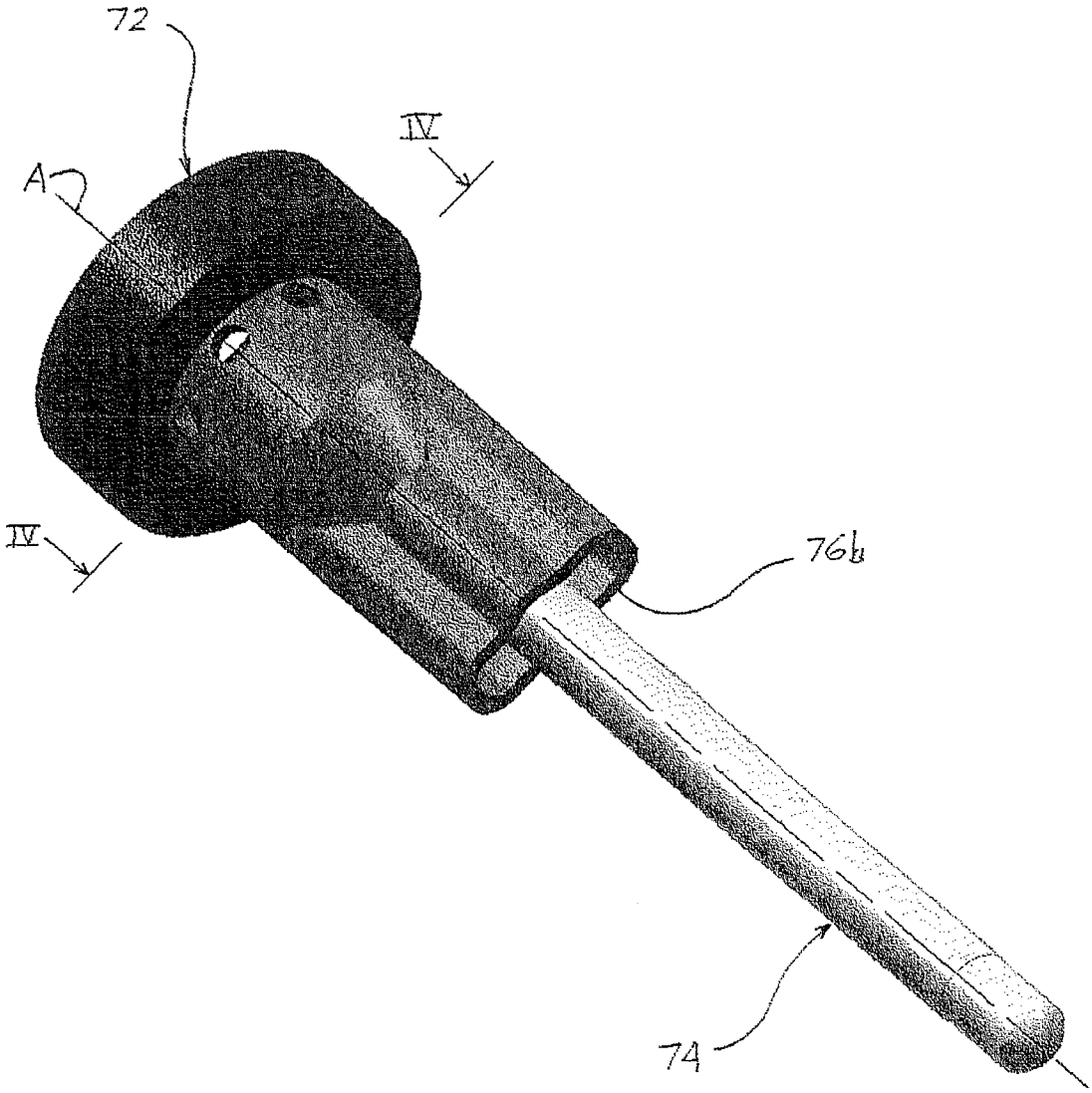
FIG. 3 is a perspective view of the closure member according to a preferred embodiment.

FIG. 1 shows an example of a fuel injector 10 including a closure member 70 according to a preferred embodiment. The fuel injector assembly 10 has a housing 11 that includes a fuel inlet 12 and a fuel outlet 14. A fuel passageway 16 extends from the fuel inlet 12 to the fuel outlet 14 along a longitudinal axis A. The housing includes an overmolded plastic member 20 cincturing a metallic support member 22.

A fuel inlet member 24 with an inlet passage 26 is disposed within the overmolded plastic member 20. The inlet passage 26 serves as part of the fuel passageway 16 of the fuel injector assembly 10. A fuel filter 28 and an adjustable tube 30 are provided in the inlet passage 26. The adjustable tube 30 is positionable along the longitudinal axis A before being secured in place, thereby varying the length of an armature bias spring 32. In combination with other factors, the length of the spring 32, and hence the bias force against the closure member 70, controls the quantity of fuel flow through the injector. The overmolded plastic member 20 also supports a socket 20*a* that receives a plug (not shown) to operatively connect the fuel injector assembly 10 to an external source of electrical potential, such as an electronic control unit (not shown). An elastomeric O-ring 34 is provided in a groove on an exterior of the inlet member 24 to sealingly secure the inlet member 24 to a fuel supply member (not shown), such as a fuel rail.

The metallic support member 22 encloses an electromagnetic actuator assembly. An example of the actuator is a coil assembly 40. The coil assembly 40 includes a bobbin 42 that retains a coil 44. The ends of the coil assembly 40 are electrically connected to pins 40*a* mounted within the socket 20*a* of the overmolded plastic member 20.

A body shell 50 engages a body 52. An armature guide eyelet 56 is located on an inlet portion 60 of the body 52. An axially extending body passage 58 connects the inlet portion 60 of the body 52 with an outlet portion 62 of the body 52. A seat 64, which is preferably a metallic material, is mounted at the outlet portion 62 of the body 52.

The body 52 includes a neck portion 66 that extends between the inlet portion 60 and the outlet portion 62. The neck portion 66 can be an annulus that surrounds a portion of the closure member 70. Thus, the closure member 70 is supported for relative movement along the longitudinal axis A with respect to the inlet member 24.

Operative performance of the fuel injector assembly 10 is achieved by magnetically coupling the closure member 70 to the end of the inlet member 26 that is closest to the inlet portion 60 of the body 52. Thus, the lower portion of the inlet member 26 that is proximate to the closure member 70 serves as part of the magnetic circuit formed with the coil assembly 40. The closure member 70 is guided by the armature guide eyelet 56 and is responsive to an electromagnetic force generated by the coil assembly 40 for axially reciprocating the closure member 70 along the longitudinal axis A of the fuel injector assembly 10. The electromagnetic force is generated by current flow from the electronic control unit (not shown) through the coil assembly 40. Movement of the closure member 70 opens and closes the seat passage 66 of the seat 64, which permits or prohibits, respectively, fuel from flowing through the fuel outlet 14 of the fuel injector 10. In the open configuration of the fuel injector 10, there exists between the closure member 70 and the coil assembly 40 a working gap, which is preferably less than about 100 microns.

Fuel that is to be injected from the fuel injector 10 is communicated from the fuel inlet source (not shown), to the fuel inlet 12, through the fuel passageway 16, and exits from the fuel outlet 14. The fuel passageway 16 includes the inlet passage 26 of the inlet member 24, the body passage 58 of the body 52, the seat passage 66 of the seat 64, and as will be discussed hereinafter, the closure member 70.

Referring additionally to FIGS. 2–5, the closure member 70 will now be discussed in greater detail. The closure member 70 is disposed in the fuel injector housing and is operable by the coil assembly 40 to permit and prohibit fuel flow through the seat passage 66 of the seat 64. Although the closure member can be an integral component, in a preferred embodiment, as shown in the drawings, the closure member 70 can include multiple components. Preferably the closure member 70 includes an magnetic member 72, a needle member 74, and a tubular member 76.

The magnetic member 72 provides a working surface for the working gap with the coil assembly 40. While the magnetic member 72 can be any shape, in a preferred embodiment, as shown in the drawings, the sleeve 72 can be an annulus that extends along the longitudinal axis A. Although in a preferred embodiment, as shown in the drawings, the magnetic member 72 is a separate member that is coupled to the tubular member 76, it is to be understood that the magnetic member 72 can be a portion of the tubular member 76.

The needle member 74 can be disposed at an end of the closure member 70 to engage the seat 64, thereby permitting and preventing fuel flow from the fuel outlet 14 of the fuel injector 10. Although in a preferred embodiment, as shown in the drawings, the needle member 74 is a separate member that is coupled to the tubular member 76, it is to be understood that the needle member 74 can be a portion of the tubular member 76.

The tubular member 76 extends along the longitudinal axis A between a first end 76*a*, which is generally proximate the inlet 12, and a second end 76*b*, which is generally proximate the outlet 14. The first end 76*a* defines a first opening 78 and the second end 76*b* defines a second opening 80 such that fuel flow in the passageway 16 includes passing through the first and second openings 78,80.

Figure 5:
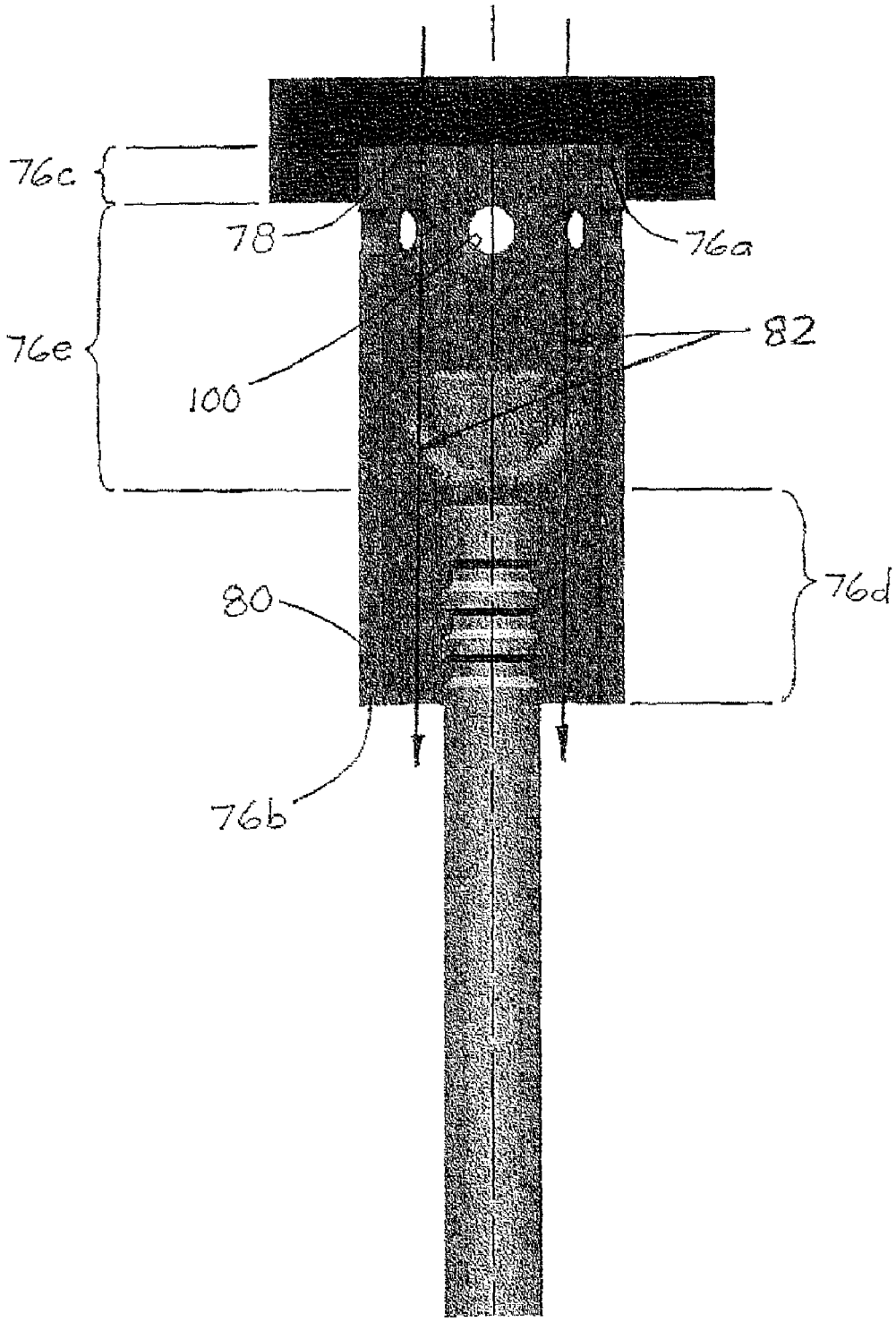
FIG. 5 is a partial cross-section view illustrating fuel flow paths through the closure member according to a preferred embodiment.

With particular reference to FIG. 5, the fuel flow through the tubular member 76 is along one or more fuel flow paths 82 (two are indicated) that are straight lines that are substantially parallel to the longitudinal axis A. That is to say, the respective portions of the first opening 78 are aligned with the second openings 80 such that the fuel flow paths 82 do not make any turns or bends.

Figure 4:
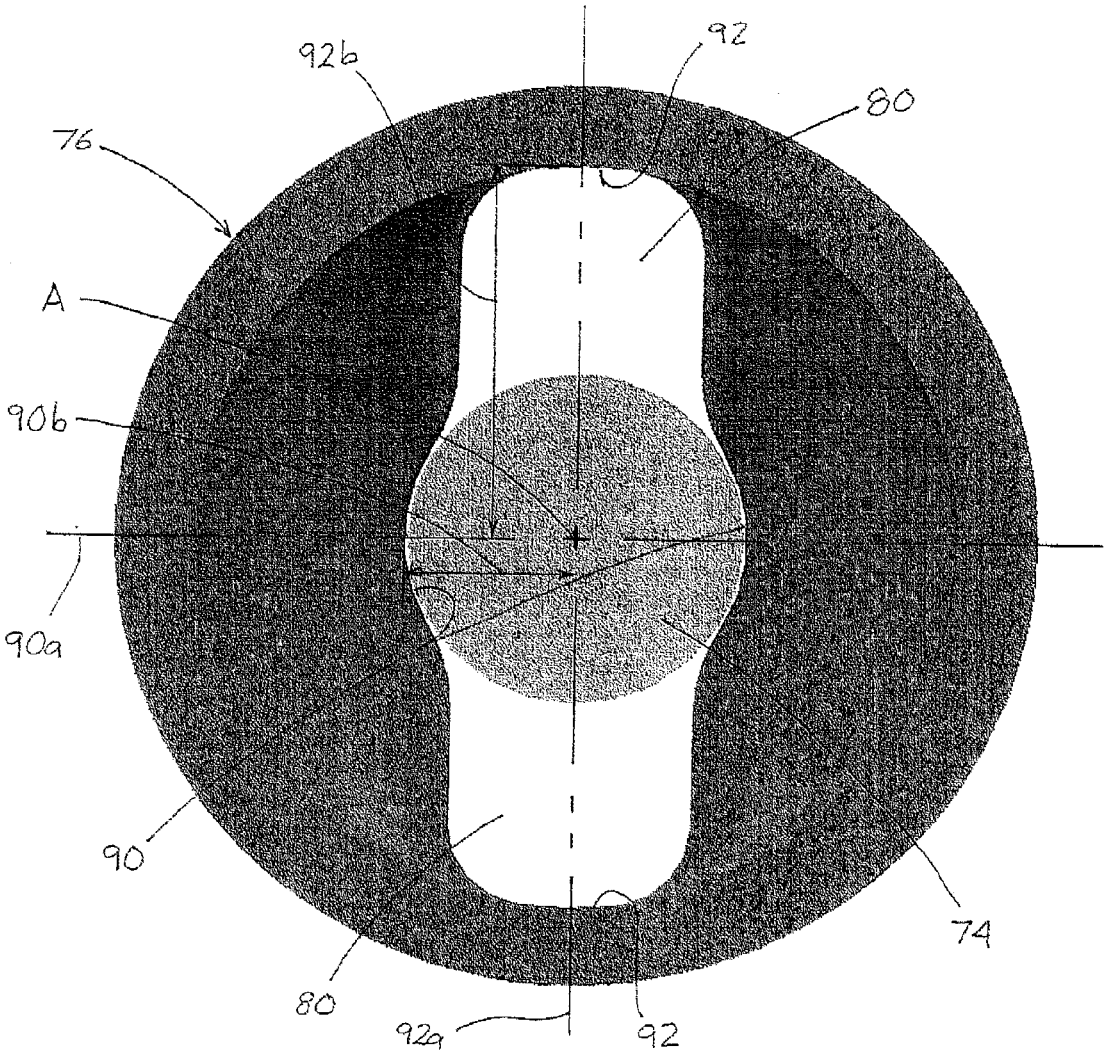
FIG. 4 is a cross-section view taken along line IV—IV in FIG. 3.

According to a preferred embodiment, the first end 76*a* of the tubular member 76 has an annular cross-section, and the second end 76*b* has a multi-lobed cross-section. With particular reference to FIG. 4, a preferred embodiment has a quad-lobe cross-section, including a pair of first lobes 90 and a pair of second lobes 92. The pair of first lobes 90 extend oppositely from the longitudinal axis A along a first axis 90*a* that is orthogonal to the longitudinal axis A. The pair of second lobes 92 extend oppositely from the longitudinal axis A along a second axis 92*a* that is orthogonal to the first and longitudinal axes 90*a*,A. Each of the first lobes 90 extend from the longitudinal axis A a distance 90*b*, and each of the second lobes 92 extends from the longitudinal axis A a distance 92*b*, which is greater than the distance 90*a*. Preferably, the distance 92*b* is at least twice as great as the distance 90*b*.

Preferably, the first lobes 90 define arcs of a circle that is generally equal to an outside diameter of the needle member 94, and gaps between the needle member 94 and the second lobes 92 define respective ones of the second openings 80.

The magnetic member 72 is coupled to a first portion 76*c* of the tubular member 76, and the needle member 74 is coupled to a second portion 76*d* of the tubular member 76. The first portion 76*c* may be welded, press fit, adhered, or otherwise fastened by any suitable means inside the magnetic member 72. As will be discussed in greater detail hereinafter, the second portion 76*d* is crimped so as to form the multi-lobed configuration of the second end 76*b*, and may then be welded, adhered, or otherwise fastened by any suitable means outside the needle member 74.

The tubular member 76 may also include an intermediate portion 76*e* between the first and second portions 76*c*,76*d*. The intermediate portion 76*e* may be perforated by at least one hole 100, which can provide an alternate flow path for fuel vapors that may arise due to engine heating of the fuel remaining in the fuel injector 10 after the engine is shut-off.

While the present invention has been disclosed with reference to certain preferred embodiments, numerous modifications, alterations, and changes to the described embodiments are possible without departing from the sphere and scope of the present invention, as defined in the appended claims. Accordingly, it is intended that the present invention not be limited to the described embodiments, but that it have the full scope defined by the language of the following claims, and equivalents thereof.

What is claimed is:

1. A fuel injector comprising:

a housing extending along a longitudinal axis between an inlet and an outlet;

a passageway through which fuel flows from the inlet to the outlet;

a coil assembly disposed proximate the inlet of the housing;

a seat disposed proximate the outlet of the housing; and a closure member disposed in the housing, the closure member being movable along the longitudinal axis between a first position prohibiting fuel flow and a second position permitting fuel flow, the closure member including:

a magnetic member adapted to cooperate with the coil assembly to move the closure member from the first position to the second position;

a needle member occluding the seat in the first position of the closure member; and a separate tubular member coupling the magnetic member to the needle member and defining a portion of the passageway, the tubular member extending between a first end defining a first opening and second end defining a second opening, and a portion of the first opening being aligned with the second opening such that fuel flow between the first and second openings is along a flow path parallel to the longitudinal axis.

2. The fuel injector according to claim 1, wherein the tubular member comprises a first portion coupled to the magnetic member and a second portion coupled to the needle member.

3. The fuel injector according to claim 2, wherein the second portion is constricted relative to the first portion.

4. The fuel injector according to claim 3, wherein the second portion is crimped so as to grip the needle member.

5. The fuel injector according to claim 2, wherein the tubular member comprises an intermediate portion between the first and second portions, and comprises at least one hole penetrating the intermediate portion.

6. The fuel injector according to claim 1, further comprising:

a resilient element extending between the closure member and the housing, the resilient element biasing the closure member toward the first position.

7. The fuel injector according to claim 6, wherein the resilient element comprises a compression spring acting on the tubular member.

8. A fuel injector comprising:

a housing extending along a longitudinal axis between an inlet and an outlet;

a passageway through which fuel flows from the inlet to the outlet;

a coil assembly disposed proximate the inlet of the housing;

a seat disposed proximate the outlet of the housing; and a closure member disposed in the housing, the closure member being movable along the longitudinal axis between a first position prohibiting fuel flow and a second position permitting fuel flow, the closure member including;

a magnetic member adapted to cooperate with the coil assembly to move the closure member from the first position to the second position;

a needle member occluding the seat in the first position of the closure member; and a tubular member coupling the magnetic member to the needle member and defining a portion of the passageway, the tubular member extending between a first end defining a first opening and second end defining a second opening, and a portion of the first opening being aligned with the second opening such that fuel flow between the first and second openings is along a flow path parallel to the longitudinal axis, the tubular member having a first portion coupled to the magnetic member and a second portion coupled to the needle member, the second portion is constricted relative to the first portion, the first portion is received in the magnetic member, and the second portion surrounds the needle member.

9. A The fuel injector comprising:

a housing extending along a longitudinal axis between an inlet and an outlet;

a passageway through which fuel flows from the inlet to the outlet;

a coil assembly disposed proximate the inlet of the housing;

a seat disposed proximate the outlet of the housing; and a closure member disposed in the housing, the closure member being movable along the longitudinal axis between a first position prohibiting fuel flow and a second position permitting fuel flow, the closure member including:

a magnetic member adapted to cooperate with the coil assembly to move the closure member from the first position to the second position;

a needle member occluding the seat in the first position of the closure member; and a separate tubular member coupling the magnetic member to the needle member and defining a portion of the passageway, the tubular member extending between a first end defining a first opening and second end defining a second opening, and a portion of the first opening being aligned with the second opening such that fuel flow between the first and second openings is along a flow path parallel to the longitudinal axis, the second end of the tubular member includes a plurality of the second openings, and each of the plurality of second openings is aligned with different portions of the first opening such that fuel flows between the first opening and each of the plurality of second openings are along a plurality of the flow paths parallel to the longitudinal axis.

10. A closure member movable along a longitudinal axis between a first position prohibiting fuel flow through a fuel injector and a second position permitting fuel flow through the fuel injector, the closure member comprising:

an acting member being influenced to cause movement from the first position to the second position;

an occluding member prohibiting fuel flow in the second position; and a separate tubular member coupling the acting member to the occluding member, the tubular member extending between a first end defining a first opening and second end defining a second opening, and a portion of the first opening being aligned with the second opening such that fuel flow between the first and second openings is along a flow path parallel to the longitudinal axis.

11. A closure member movable along a longitudinal axis between a first position prohibiting fuel flow through a fuel injector and a second position permitting fuel flow through the fuel injector, the closure member comprising:

an acting member being influenced to cause movement from the first position to the second position, the acting member cinctures the tubular member with respect to the longitudinal axis, and the tubular member cinctures the occluding member with respect to the longitudinal axis;

an occluding member prohibiting fuel flow in the second position; and a tubular member coupling the acting member to the occluding member, the tubular member extending between a first end defining a first opening and second end defining a second opening, and a portion of the first opening being aligned with the second opening such that fuel flow between the first and second openings is along a flow path parallel to the longitudinal axis.

12. The closure member according to claim 11, wherein a coupling cincturing the tubular member to the occluding member comprises a crimp.

13. The closure member according to claim 11, wherein a coupling cincturing the acting member to the tubular member comprises at least one of a weld, a press fit, a weld, a crimp, and an adhesive.

14. A closure member movable along a longitudinal axis between a first position prohibiting fuel flow through a fuel injector and a second position permitting fuel flow through the fuel injector, the closure member comprising:

an acting member being influenced to cause movement from the first position to the second position;

an occluding member prohibiting fuel flow in the second position; and a separate tubular member coupling the acting member to the occluding member, the tubular member extending between a first end defining a first opening and second end defining a second opening, and a portion of the first opening being aligned with the second opening such that fuel flow between the first and second openings is along a flow path parallel to the longitudinal axis, the first end of the tubular member includes an annular cross-section transverse to the longitudinal axis, and the second end of the tubular member comprises a quad-lobe cross-section transverse to the longitudinal axis.

15. The closure member according to claim 14, wherein the quad-lobe cross-section comprises pairs of first and second lobes, the pair of first lobes extend oppositely from the longitudinal axis along a first axis that is orthogonal to the longitudinal axis and the pair of second lobes extend oppositely from the longitudinal axis along a second axis that is orthogonal to the first and longitudinal axes.

16. The closure member according to claim 15, wherein each of the pair of the first lobes extends from the longitudinal axis a first distance, each of the pair of the second lobes extends from the longitudinal axis a second distance, and the second distance is greater than the first distance.

17. The closure member according to claim 16, wherein the second distance is at least twice as great as the first distance.

18. The closure member according to claim 16, wherein the first lobes define arcs of a circle generally equal to a diameter of the occluding member, and gaps between the occluding member and the second lobes define a pair of the second openings.

* * * * *